United States Patent [19]

Dantlgraber

[11] Patent Number: 4,468,173

[45] Date of Patent: Aug. 28, 1984

[54] CONTROL DEVICE FOR A VARIABLE DISPLACEMENT PUMP

[75] Inventor: Jörg Dantlgraber, Lohr-Sackenbach, Fed. Rep. of Germany

[73] Assignee: Mannesmann Rexroth GmbH, Lohr, Fed. Rep. of Germany

[21] Appl. No.: 373,808

[22] Filed: Apr. 30, 1982

[30] Foreign Application Priority Data

May 11, 1981 [DE] Fed. Rep. of Germany ..... 3118576

[51] Int. Cl.³ ..... F04B 49/08

[52] U.S. Cl. ..... 417/220; 60/452; 60/468; 417/222; 417/299

[58] Field of Search ..... 417/218, 220, 222, 299, 417/213; 60/452, 468, 445

[56] References Cited

U.S. PATENT DOCUMENTS

| | | | |
|---|---|---|---|
| 3,635,021 | 1/1972 | McMillen et al. | 417/213 X |
| 3,768,928 | 10/1973 | Miller et al. | 417/213 |
| 3,948,147 | 4/1976 | Sauer et al. | 417/299 X |
| 4,293,284 | 10/1981 | Carlson et al. | 417/218 |

FOREIGN PATENT DOCUMENTS

| | | | |
|---|---|---|---|
| 2952083 | 6/1981 | Fed. Rep. of Germany | 417/220 |

*Primary Examiner*—Edward K. Look

*Attorney, Agent, or Firm*—Posnack, Roberts, Cohen & Spiecens

[57] ABSTRACT

A pressure control valve is provided for controlling both the low and high pressure ranges of a variable displacement pump in addition to the pressure control valve used for adjusting the variable displacement member of the variable displacement pump.

10 Claims, 3 Drawing Figures

FIG.1
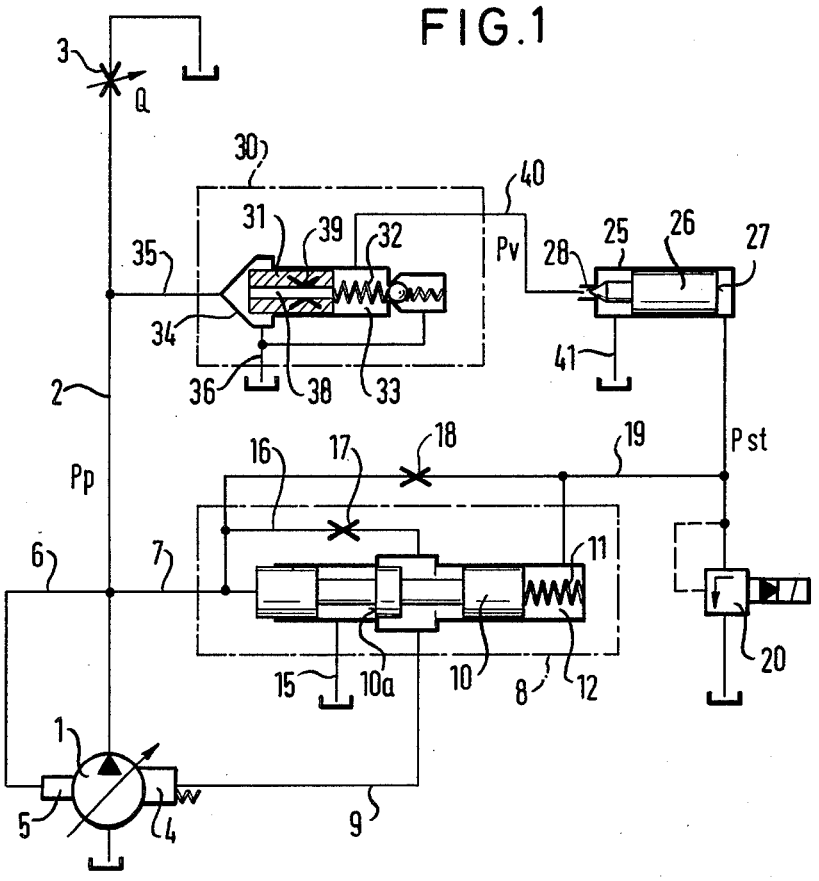
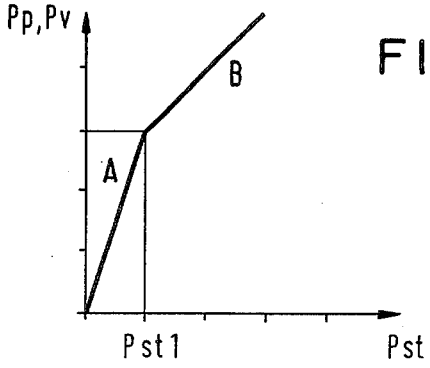
FIG. 2

CONTROL DEVICE FOR A VARIABLE DISPLACEMENT PUMP

BACKGROUND OF THE INVENTION

The present invention relates in general to a control device for a variable displacement pump and in particular to a variable displacement pump, the adjusting element of which for controlling the volume of flow is controlled by a pressure control valve which applies and/or releases pressure medium to or from the adjusting element in response both to the pressure existing in the pressure line of the pump and an adjustable control pressure as a reference input value.

In machines having hydraulic servos, particularly in the field of plastic injection molding machines, there is a necessity to produce a large flow and high pressure from a relatively low level pressure and reduced flow across the load within the shortest possible period of time; such high pressure is subsequently to be maintained with a minimum amount of flow. Such conditions, for example, may occur in blow forming machines where the two mating parts of the blow mold are first to be closed whereupon such closure is to be maintained under high pressure.

It has been suggested to arrange a remote control pressure relief valve in the pressure line of the pump. This arrangement, however, exhibits the drawback that the power consumption of the pump will be exceedingly large when the pressure line is highly pressurized because the entire flow of the pump will bypass into the tank via the pressure relief valve across which the system pressure is relieved.

It is, therefore, advantageous to select a variable displacement pump of the type where the flow may be adjusted by a remote control pressure valve. The remote control pressure valve reduces the flow of the variable displacement pump to the level necessary for maintaining the pressure. This arrangement is well adapted to the control of high pressures; it makes it, however, very difficult to achieve zero or idle stroke pressures within a range of 10 bars or less.

Moreover, it is impossible to adjust the variable displacement pump from a low level pressure position into the maximum flow position in a very short period of time. The cause may be seen in the fact that with the very low level pressure in the pressure line, no hydraulic force will be available for displacing the pump. A further drawback is that neither the cooling nor filtering systems will effectively operate in the idle stroke position of the pump.

SUMMARY OF THE INVENTION

Accordingly, it is an object of the present invention to provide a control device by which lower level pressures may be precisely controlled in a simple manner in addition to controlling the higher pressures.

Another object is to achieve a short acting time for the variable displacement pump to adjust the desired pressure.

These and other objects and features of the invention are set forth in the detailed description of a preferred embodiment to follow.

According to the teachings of the invention there is provided a combined pressure adjustment for both the variable displacement pump and the pressure control valve. Below a predetermined control pressure the pressure control valve of the pump is maintained in a position in which the variable displacement pump operates at maximum flow. In this range, the pressure control valve is effective to control the pressure line, wherein the flow will pass into the tank through the pressure control valve in a controlled manner.

When the predetermined control pressure is exceeded the pressure control valve will close and be ineffective while control is now effected by the pressure control valve of the variable displacement pump which may reduce the volume of the pump from its maximum output down to idle stroke operation whereby the highest pressure possible is being built up in the pressure line.

According to the invention, low level pressures as well may be successfully controlled. Further, the change from the state of "low pressure, no or little flow" to "high pressure and large flow" will be effected in a very short period of time because the pump is not required to be set into maximum flow position, as the pump is already in this position when the pressure control valve closes. In addition, cooling and filtering is maintained during any periods of time in which no flow and no pressure is applied to the load.

BRIEF DESCRIPTION OF THE DRAWINGS

The specific embodiment of the invention which is described in detail below is set forth by way of example only and should not be construed as to limit the scope of the invention which is defined in the appended claims. In the attached drawings:

FIG. 1 is a schematic drawing of a control device for a variable displacement pump according to the invention;

FIG. 2 is a graph showing the control characteristic of the control device of FIG. 1.

DETAILED DESCRIPTION OF A PREFERRED EMBODIMENT OF THE INVENTION

Figure 3:
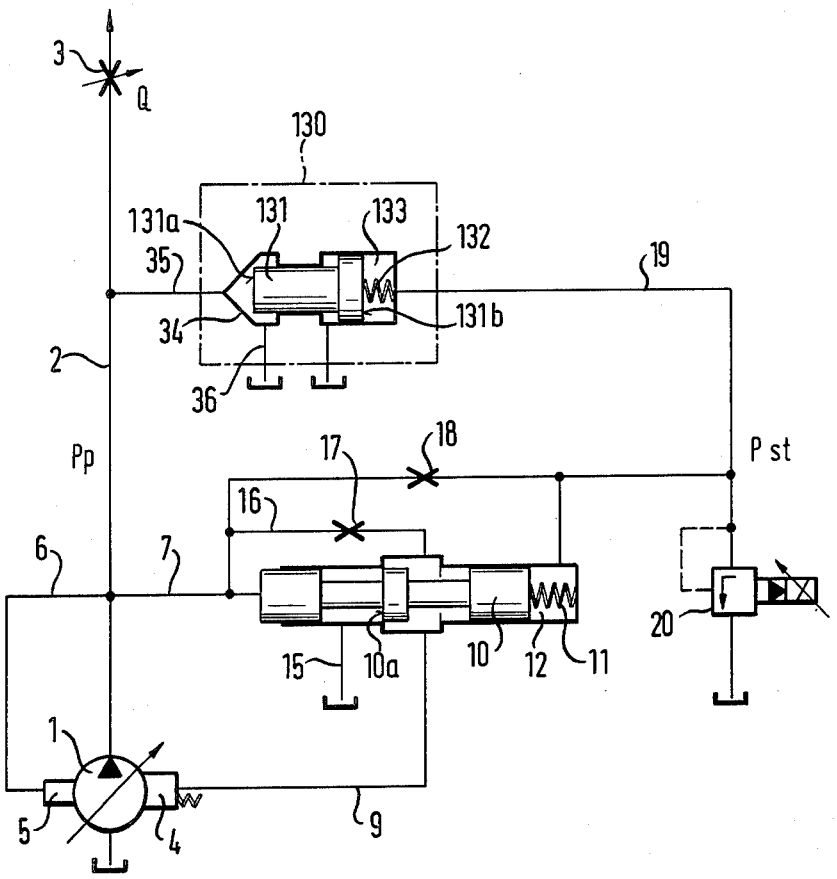
FIG. 3 is a modified embodiment of the control device of FIG. 1.

Referring to FIG. 1, a variable displacement pump 1 supplies fluid to a load 3 through a pressure line 2. The variable displacement pump 1 may be, by way of example, a radial or axial piston pump or, alternately, a variable pump. In the present embodiment it has been designed as a variable vane pump of the type in which the stator (not shown) is urged by a displacing piston 4 into the maximum volume position while a displacing piston 5 having a smaller cross section urges the stator towards "minimum volume". Pressure is applied to the displacing piston 5 from the pressure line 2 through line 6 while the displacing piston 4 is acted upon from pressure line 2 through line 7, a pressure control valve 8 and a line 9.

The pressure control valve 8 has a control piston 10 at whose left cross sectional area, viewing FIG. 1, pressure is applied from the pressure line 2 through line 7 while the right-hand end face, again viewing FIG. 1, is engaged by a biasing spring 11 and a control pressure in a control chamber 12. The biasing force of spring 11 is so strong as to urge the control piston 10 into the position shown at lower pressure levels prevailing in pressure line 2, wherein the connection of line 9 to a passage 15 leading to a tank through a control edge 10*a* of the control piston is shut-off. In this position of the control piston, line 9 is connected through a passage 16 to line 7 in which there is arranged a restriction 17. Thus, pressure is applied from pressure line 2 to the displacing piston 4, to cause the variable displacement pump 1 to supply full flow at low pressure level.

The line 7 is further connected, through a throttle means 18, to a control pressure line 19 to which a pressure relief valve 20 is connected. The pressure relief valve 20 is provided to control the pressure in line 19 to a valve which may be set on the pressure relief valve. This control pressure is proportional to the pressure prevailing in pressure line 2; by way of example a pressure $P_p$ of 20 bars in line 2 is predetermined by a control pressure pSt of 1 bar.

As long as the control pressure does not exceed the value $pSt_1$ indicated in FIG. 2, the pressure control valve 8 is in the above mentioned position in which the variable displacement pump 1 supplies maximum flow and in which control is solely effected by a pressure control valve 30. The pressure control valve 30 is comprised of a closure body 31 which is urged by a spring 32 in control chamber 33 against a valve seat 34. When the closure body 31 is lifted off the valve seat 34, pressure fluid is allowed to flow from the pressure line 2 through lines 35 and 36 to the tank.

Moreover, the closure body 31 is formed with a bore 38 in which there is arranged a throttle means 39. Pressure fluid flows through the bore 38 into the control chamber 33.

The pressure Pv in the control chamber 33 determining the adjusting pressure of control valve 30 is set by means of a pressure transducing valve 25. To accomplish this, the control chamber 33 is connected to the pressure transducing valve 25 through a line 40. The pressure transducing valve has a differential piston 26 whose larger cross sectional area is acted upon by the control pressure from line 19 while the pressure Pv is effective to act upon the smaller seat area 28 of the differential piston 26.

Consequently, the pressure transducing valve 25 is opened at low control pressure levels releasing the pressure from control chamber 33 through the line 40 and the return line 41 to the tank. This permits the pressure control valve 30 to open whereby full flow of the variable displacement pump 1 is allowed to pass through the lines 35 and 36 to the tank. With an increasing control pressure less fluid flows from the control chambers 33 through the pressure transducing valve 25 to the tank, effecting a pressure increase in the control chamber 33 and consequently an increase of the pressure $P_p$ in the pressure line. This range is covered by curve A in FIG. 2.

Upon reaching a predetermined control pressure $pSt_1$ the pressure transducing valve 25 cuts off the connection to the tank, and the pressure control valve 30 is closed by a supplementary flow of fluid from line 35 through the bore 38 in the control chamber 33. This will render the pressure control valve inoperative. Further control is then effected through the pressure control valve 8. The rising pressure of $P_p$ in the pressure line will act to displace or slide the control piston 10 to the right which establishes the connection of line 9 to the tank through control edge 10*a* and line 15. This is effective to control the variable displacement pump towards a state of zero stroke, the control pressure in line 19 acting through line 20 upon the control chamber 12 of the pressure control valve 8. This results in curve B shown in FIG. 2.

The ratio Pv/pSt results from the interrelated proportions of the cross sectional areas of the differential piston of the pressure transducing valve 25. This serves to achieve a relatively steep-fronted curve A and a defined point of intersection with the flatter curve B of the pressure control valve 8.

In a modified embodiment of the invention (not shown) the pressure transducing valve 25 may be omitted. It is replaced by a switch which reduces the pressure in the control chamber to zero within the range of curve A, i.e. below the set control pressure $pSt_1$, by directly connecting the control chamber 33 to the tank. As the control pressure pSt rises to the predetermined value, the connection of the control chamber to the tank is interrupted while the pressure control valve 30 is closed as mentioned above.

In FIG. 3 a modified embodiment of the invention is shown in which components identical to those of FIG. 1 are given identical numerals.

The modification actually relates only to a pressure control valve 130 whose closure body 131 has been constructed as a differential piston whose cross sectional area 131*a*, which is exposed to the pressure of pressure line 2 is smaller than the end surface 131*b* which is disposed within a control chamber 133. Accordingly, the different areas 131*a* and 131*b* replace the amplifying function of the pressure transducing valve 25. As mentioned above, the closure body 131 is urged by a spring 132 in the closing direction. The pressure control line 19 leads directly to the control chamber 133.

Having fully expounded the object's advantages and novel features of the invention, we claim:

1. In a control device for a variable displacement pump having an adjusting element for controlling the volume of flow of fluid from the pump to a pump pressure line, the control device including a pressure control valve means, which supplies or removes pressure medium to or from said adjusting element in response both to the pressure existing in the pump pressure line and an adjustable control pressure as a reference input value, the improvement comprising a second pressure control valve means connected to the pressure line in addition to the first pressure control valve means, said first pressure control valve means being maintained in a position corresponding to maximum volume flow of the displacement pump, while the pressure in the pressure line is controlled by said second pressure control valve means, when low control pressure prevails, said second pressure control valve means being maintained in a closed position and the pressure in the pressure line being controlled by the first pressure control valve means when a predetermined value of control pressure is exceeded, said second control valve means including a control chamber means, which is depressurized when the control pressure is below said predetermined value of control pressure, the improvement further comprising a further valve means subject to said control pressure and connected to said control chamber means for controlling depressurization thereof.

2. A control device as claimed in claim 1, wherein said first pressure control valve means includes a control piston means which is actuated by the pressure in the pressure line in one direction and by the control pressure plus a biasing spring means in the opposite direction, the force of the biasing spring means being selected so that, against the pressure in the pressure line, the control piston means is maintained in a position in which the adjusting element of the pump is acted upon by fluid pressure until the control pressure exceeds said predetermined value, whereupon said second pressure control valve means closes and said control piston means is adjusted in response to the pressure of the pump.

3. A control device as claimed in claim 1 comprising a control pressure line for the first and second pressure control valve means, a restriction means connecting said control pressure line to the pressure line of the pump, and a pressure relief valve means for adjusting the pressure in the control pressure line.

4. A control device as claimed in claim 1, wherein said further valve means includes a differential piston means having a larger cross sectional area acted upon by the control pressure.

5. In a control device for a variable displacement pump having an adjusting element for controlling the volume of flow of fluid from the pump to a pump pressure line, the control device including a pressure control valve means, which supplies or removes pressure medium to or from said adjusting element in response both to the pressure existing in the pump pressure line and an adjustable control pressure as a reference input value, the improvement comprising a second pressure control valve means connected to the pressure line in addition to the first pressure control valve means, said first pressure control valve means being maintained in a position corresponding to maximum volume flow of the displacement pump, while the pressure in the pressure line is controlled by said second pressure control valve means, when low control pressure prevails, said second pressure control valve means being maintained in a closed position and the pressure in the pressure line being controlled by the first pressure control valve means when a predetermined value of control pressure is exceeded, said second control valve means including a control chamber means, which is depressurized when the control pressure is below said predetermined value of control pressure, said second control valve means having a bore provided with a throttle means connecting said pressure line to said control chamber means to close said second pressure control valve means as soon as said pressure chamber means is pressurized upon achieving said predetermined value of control pressure.

6. A control device as claimed in claim 5 wherein said first pressure control valve means includes a control piston means which is actuated by the pressure in the pressure line in one direction and by the control pressure plus a biasing spring means in the opposite direction, the force of the biasing spring means being selected so that, against the pressure in the pressure line, the control piston means is maintained in a position in which the adjusting element of the pump is acted upon by fluid pressure until the control pressure exceeds said predetermined value, whereupon said second pressure control valve means closes and said control piston means is adjusted in response to the pressure of the pump.

7. A control device as claimed in claim 5 comprising a control pressure line for the first and second pressure control valve means, a restriction means connecting said control pressure line to the pressure line of the pump, and a pressure relief valve means for adjusting the pressure in the control pressure line.

8. In a control device for a variable displacement pump having an adjusting element for controlling the volume of flow of fluid from the pump to a pump pressure line, the control device including a pressure control valve means, which supplies or removes pressure medium to or from said adjusting element in response both to the pressure existing in the pump pressure line and an adjustable control pressure as a reference input value, the improvement comprising a second pressure control valve means connected to the pressure line in addition to the first pressure control valve means, said first pressure control valve means being maintained in a position corresponding to maximum volume flow of the displacement pump, while the pressure in the pressure line is controlled by said second pressure control valve means, when low control pressure prevails, said second pressure control valve means being maintained in a closed position and the pressure in the pressure line being controlled by the first pressure control valve means when a predetermined value of control pressure is exeeded, said second control valve means including a control chamber means, which is depressurized when the control pressure is below said predetermined value of control pressure, said second pressure control valve means comprising a closure body constructed as a differential piston means having a larger cross-secton area actuated by the control pressure from the control pressure line leading to the control chamber means.

9. A control device as claimed in claim 8 wherein said first pressure control valve means includes a control piston means which is actuated by the pressure in the pressure line in one direction and by the control pressure plus a biasing spring means in the opposite direction, the force of the biasing spring means being selected so that, against the pressure in the pressure line, the control piston means is maintained in a position in which the adjusting element of the pump is acted upon by fluid pressure until the control pressure exceeds said predetermined value, whereupon said second pressure control valve means closes and said control piston means is adjusted in response to the pressure of the pump.

10. A control device as claimed in claim 8 comprising a control pressure line for the first and second pressure control valve means, a restriction means connecting said control pressure line to the pressure line of the pump, and a pressure relief valve means for adjusting the pressure in the control pressure line.

* * * * *